US006647406B1

(12) United States Patent
Maruo et al.

(10) Patent No.: US 6,647,406 B1
(45) Date of Patent: Nov. 11, 2003

(54) SUM OF PRODUCT CIRCUIT AND INCLINATION DETECTING APPARATUS

(75) Inventors: Kazuyuki Maruo, Tokyo (JP); Tadashi Shibata, Tokyo (JP)

(73) Assignee: Advantest Corporation, Tokyo (JP)

( * ) Notice: Subject to any disclaimer, the term of this patent is extended or adjusted under 35 U.S.C. 154(b) by 0 days.

(21) Appl. No.: 09/444,721

(22) Filed: Nov. 24, 1999

(30) Foreign Application Priority Data

Nov. 25, 1998 (JP) ..... 10-333669
Oct. 28, 1999 (JP) ..... 11-307321

(51) Int. Cl.[7] ..... G06G 7/164; G06G 7/12
(52) U.S. Cl. ..... 708/835; 708/813
(58) Field of Search ..... 708/835, 813; 327/427, 429, 541

(56) References Cited

U.S. PATENT DOCUMENTS 5,719,520 A * 2/1998 Au et al. ..... 327/427
6,070,183 A * 5/2000 Kawakami et al. ..... 708/813
6,133,780 A * 10/2000 Chi ..... 327/541

* cited by examiner

*Primary Examiner*—Tan V. Mai
(74) *Attorney, Agent, or Firm*—Rosenthal & Osha L.L.P.

(57) ABSTRACT

A sum of product circuit (20) which adds up two input voltages, each of which is multiplied by the prescribed coefficients. The sum of product circuit (20) has a ν MOS transistor (50), a first and a second capacitance (C1, C2), and an output terminal (86). The ν MOS transistor (50) includes a drain (70), source (72), and a floating gate (74). The first and a second capacitance (C1, C2) connects each of two input voltages to the floating gate (74) by capacity coupling. The output terminal (86) outputs a voltage realized between a resister element (R0) and the ν MOS transistor (50). A constant voltage is applied between the drain (70) and the source (72) through the resister element (R0).

8 Claims, 13 Drawing Sheets

SUM OF PRODUCT CIRCUIT AND INCLINATION DETECTING APPARATUS

This patent application claims priority based on a Japanese patent application, H10-333669 filed on Nov. 25, 1998, and H11-307321 filed on Oct. 28, 1999, the contents of which are incorporated herein by reference.

BACKGROUND OF THE INVENTION

1. Field of the Invention

The present invention relates to a sum of product circuit and an inclination detecting apparatus. In particular, the present invention relates to a sum of product circuit and an inclination detecting apparatus that uses said sum of product circuit to calculate the analog multilevel data accurately and at high-speed.

2. Description of the Related Art

When using an analog quantity, a computer usually initially converts an analog quantity to a digital quantity using an A/D converter, and then operates the digital processing. The digital processing is accurate, but the quantity of the data becomes enormous and the steps of process also become large. Therefore, it is difficult to respond in real time, especially if the information processing such as recognition of a specific shape from a two-dimensional picture is processed by a digital circuit.

For example, as a method of detecting a location and a rotation angle of a line existing in a binary picture, there is an image processing method known as a linear Hough conversion. The linear Hough conversion inputs a coordinate value of an active picture element in a binary picture, such as picture element of picture element value "1". The linear Hough conversion then operates a circular function and a sum of the product operation, then maps the results of the operation on two-dimensional memory. The linear Hough conversion is not sensitive to noise. The linear Hough conversion can detect a rotation angle of a line even if the line is cut halfway or if a plurality of lines are crossed in a complicated pattern. Therefore, the linear Hough conversion is used in various fields such as real time image processing.

FIG. 1 shows a Hough conversion integrated circuit that uses a digital signal processing circuit to process the linear Hough conversion shown above, in real time. The Hough conversion integrated circuit is constituted by a Metal Oxide Semiconductor (MOS), logic circuit, or a logic integrated circuit such as a Transistor Transistor Logic (TTL). The Hough conversion integrated circuit has an address output means 12, a ROM (Read Only Memory) 16, and a sum of product circuit 20. The address output means 12 outputs an active picture element address of a binary picture, input to the address output means 12 sequentially. The ROM 16 stores a circular function table 18. The sum of product circuit 20 operates the sum of the product operation, based on the address output from the address output means 12 and a circular function read from the circular function table 18.

The linear Hough conversion integrated circuit further has a two-dimensional memory 24, a maximum value detecting unit 26, and an inclination output unit 28. The two-dimensional memory 24 stores the results of the sum of the product operation. The maximum value detecting unit 26 detects a maximum value from the storing value stored in the two-dimensional memory 24. The inclination output unit 28 outputs an inclination of an input picture, based on the maximum value which is detected by the maximum value detecting unit 26.

To operate the Hough conversion shown above using logic circuit, a two step process is required. The first is storing the data from the ROM 16, which stores the circular function table 18, and the second is operating the sum of the product operation on digital address data output from the address output means 12, and a circular function. Furthermore, to operate the sum of the product operation process to an accuracy of for example 8 bit, eight steps of logical multiplication process and eight steps of parallel full adder process are required. The result is, an increase in the circuit delay.

If this Hough conversion circuit is comprised for example of CMOS (Complementary MOS) logic circuit with an 8 bit operation accuracy, approximately 100 transistors are needed in the ROM, which stores the circular function, and 1500 transistors are needed in the sum of the product circuit. Thus, a total of 1600 transistors are needed. It is possible to use a plurality of Hough conversion circuits in parallel to increase the processing speed. In the case of using sixty Hough conversion circuits in parallel, approximately 100, 000 transistors are needed. In this case, the whole area of the LSI chip is dominated by the Hough conversion circuit using the present high integration technology. Therefore, the two-dimensional memory and other circuits have to be assembled into other chips so that the. Hough-conversion circuit as a whole becomes a large scale circuit configuration which includes a plurality of chips.

SUMMARY OF THE INVENTION

Therefore, it is an object of the present invention to provide a semiconductor integrated circuit which can increase processing speed, reduce circuit scale, and process data in parallel by introducing MOS analog circuit technology into a Hough conversion operation integrated circuit. This was constituted by a logic integrated circuit in the past. This object is achieved by combinations described in the independent claims. The dependent claims define further advantageous and exemplary combinations of the present invention.

According to the first aspect of the present invention, a sum of product circuit, which adds two input voltages, each of which is multiplied by prescribed coefficients, may comprise a ν MOS transistor which has a drain, a source, and floating gate; a first and second capacitance which connect each of two input voltage to the floating gate by capacity coupling; a resister element which has prescribed resistance; and an output terminal which outputs a voltage generated between the resister element and the ν MOS transistor; wherein a constant voltage is applied between the drain and the source through the resister element.

The resister element may have a MOS transistor. A sum of product circuit may further have a third condenser which connects the floating gate and ground. The ν MOS transistor may be an N channel ν MOS transistor, and the drain may be connected to an electric potential higher than an electric potential of the source. The ν MOS transistor may be a P channel ν MOS transistor, and the source may be connected to an electric potential higher than an electric potential of the drain. A sum of product circuit may further comprise a plurality of ν MOS transistors wherein the resister element and the first and second condenser can be provided independently for each of the plurality of ν MOS transistors.

By equalizing the value of the first capacitance and the second capacitance to the value of sin θ and cos θ at various angles θ, the sum of the product circuit can sum at high speed the products of sin θ and cos θ at various angles θ and the addresses in the x direction and the y direction. Therefore, Hough conversion can be processed at high speed. In this case, a sum of the square of a capacitance of the first condenser and the square of a capacitance of the second condenser becomes equal for each of the plurality of ν MOS transistors.

A sum of product circuit may further comprise a switch which connects the floating gate to ground electric potential. Using this switch, the initial charge of the floating gate can be used repeatedly, so that the tunnel charge stored in the floating gate can be initialized. Therefore, the sum of the product operation can be processed accurately. The switch can be comprised of a CMOS switch or a combination of a resistor and a capacitor.

According to the second aspect of the present invention, an inclination detecting apparatus which detects the inclination of an input picture comprises, an address output means which outputs each address in the x direction and y direction of a plurality of active picture elements included in the input picture; a D/A converter which converts each of the addresses in the x direction and y direction output from the address output means to an analog value; an analog sum of product circuit, which adds a value produced by multiplying the address in the x direction and y direction (which is converted to an analog value by the D/A converter) by a value cos θ and sin θ at a plurality of angles θ; a memory in which an address is determined based on the result of the sum of product and the angle θ; an increase means which increases a stored value of the address determined, based on the result of the sum of product and the angle θ in the memory, for every active picture element; and an inclination calculating means which calculates the inclination based on the storing value stored in the memory.

The analog sum of product circuit may have an A/D converter which converts the result of the sum of product to at least part of the addresses of the memory. The inclination calculating means may have a maximum value detecting unit which detects a maximum storing value stored in the two-dimensional memory, and an inclination output unit which outputs the angle θ as the inclination, based on an address of the storing value detected by the maximum value detecting unit.

This summary of the invention does not necessarily describe all necessary features so that the invention may also be a sub-combination of these described features.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
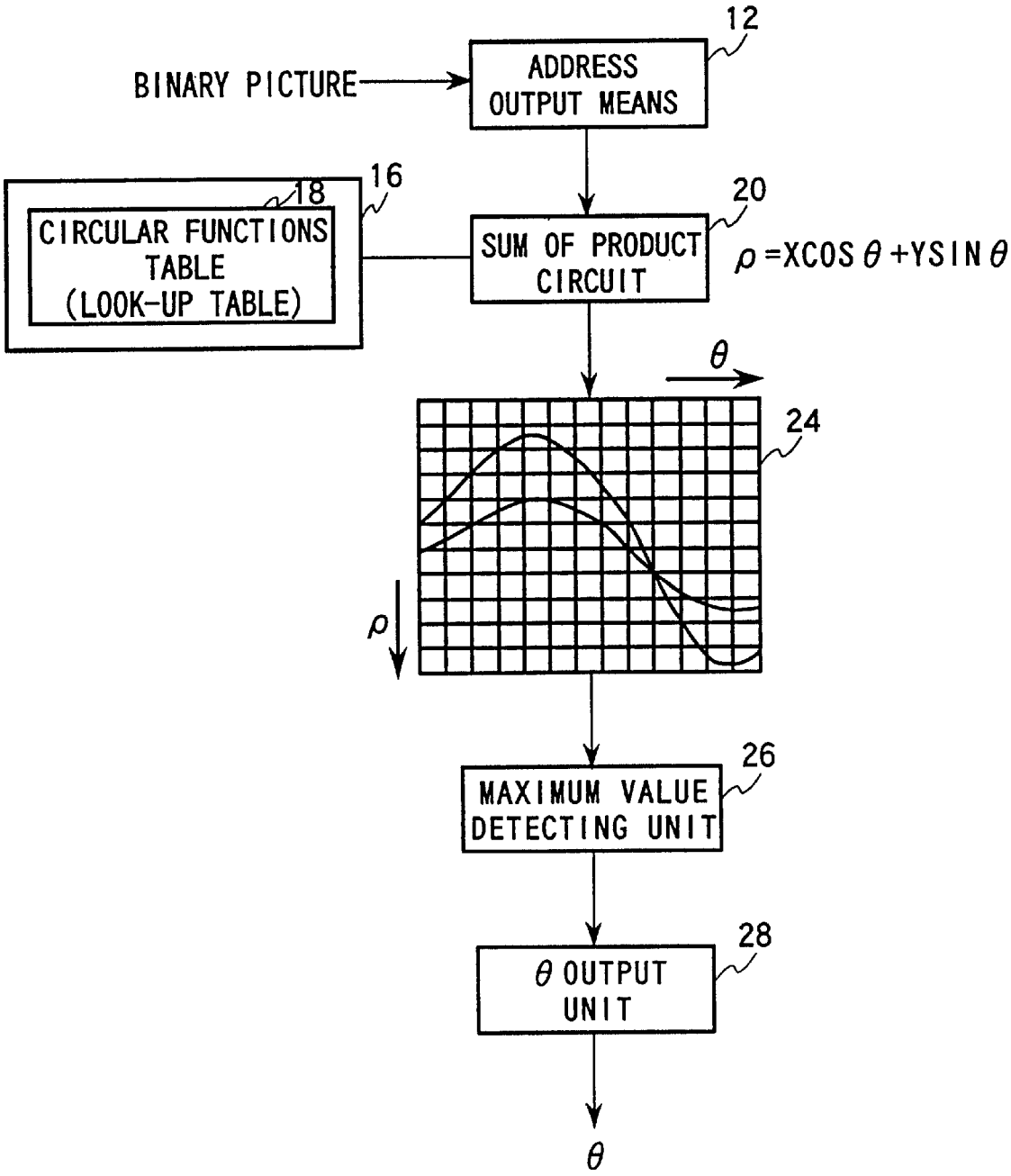
FIG. 1 (PRIOR ART)
FIG. 1 shows a block diagram of a configuration of a conventional inclination detecting apparatus.
Figure 2:
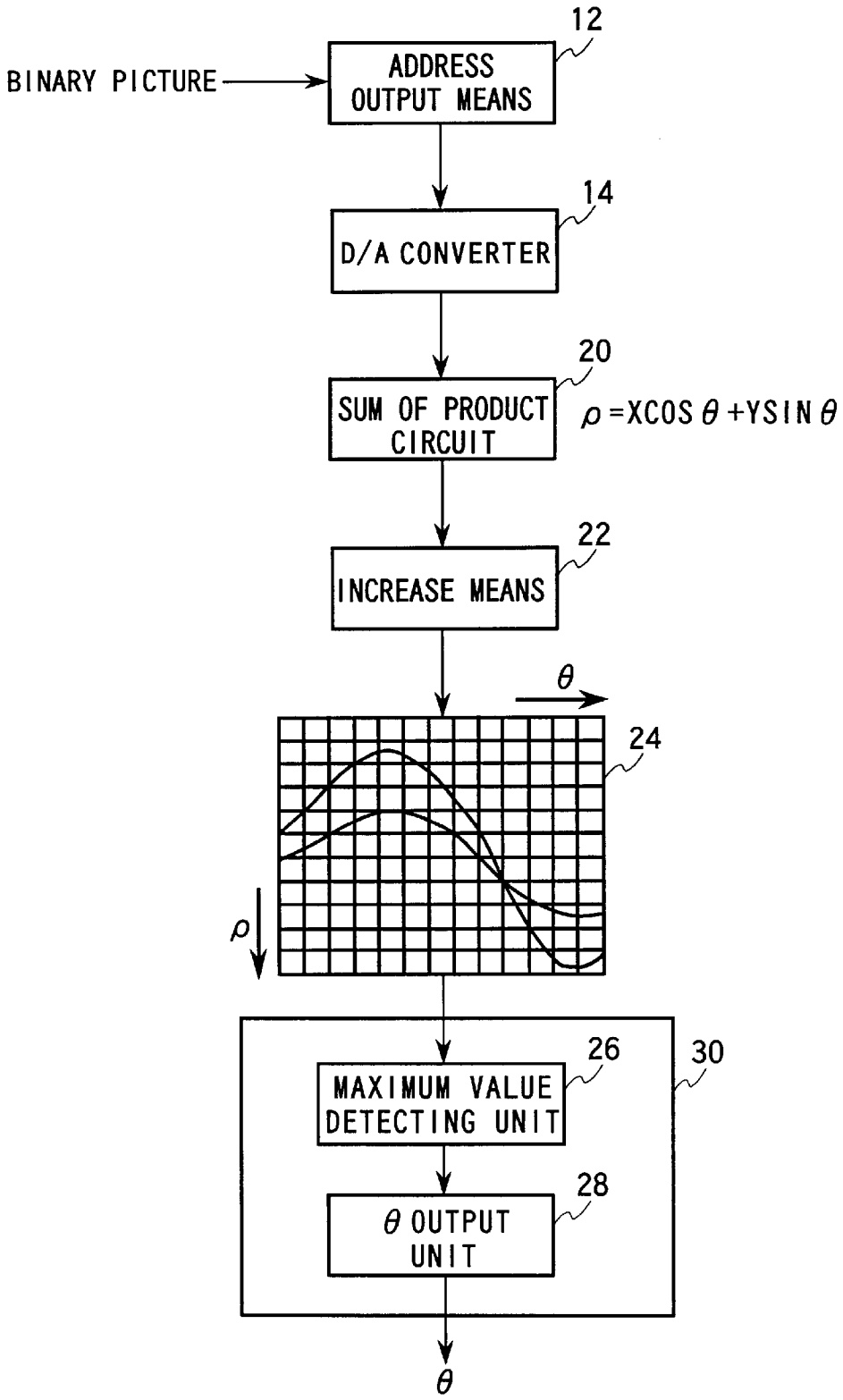
FIG. 2 shows a block diagram of a configuration of an inclination detecting apparatus of the present embodiment.

FIG. 2 shows a block diagram of a configuration of an inclination detecting apparatus of the first embodiment of the present invention. The inclination detecting apparatus of the present invention has an address output means 12, a D/A converter 14, a sum of product circuit 20, an increase means 22, a memory 24, and an inclination calculating means 30. The address output means 12 outputs an active picture element address of a binary picture, which is input to the address output means 12. The D/A converter 14 converts the address output from the address output means 12 to an analog value.

The sum of product circuit 20 multiplies the address, which is converted to an analog value by the D/A converter 14, by a value of cos θ and sin θ at various angles θThe increase means 22 increases the value of the address that is determined, based on the value ρ calculated by the sum of product circuit 20 and the angle θ corresponding to the value ρ. The memory 24 stores the value of the address output from the increase means 22.

The inclination calculating means 30 calculates the inclination of the input picture based on the data stored in the memory 24. The inclination calculating means 30 includes a maximum value detecting unit 26 and an inclination output unit 28. The maximum value detecting unit 26 detects the maximum value in the data stored in the memory 24. The inclination output unit 28 calculates the inclination θ of the input picture based on the address of the data detected by the maximum value detecting unit 26, and outputs the calculated inclination θ.

The input binary value has an active picture element, which is a picture element having a picture element value 1, and a non-active picture element, which is a picture element having a picture element value 0. As an example of an active picture element, there is a picture element detected as an edge of the object input as a binary value. As an example of a non-active picture element, there is a picture element other than an edge of the above object. The address output means 12 outputs the coordinate value of the active picture element in the input binary picture. The sum of product circuit 20 operates the linear Hough conversion by summing the products of the coordinate value in x direction and y direction by a circular function. The result of the linear Hough conversion is stored in the two-dimensional memory 24.

The maximum value detecting unit 26 detects the data having the maximum value in the two-dimensional memory 24. The inclination output unit 28 detects the location and the inclination of the line existing in the input binary picture, based on the address detected by the maximum value detecting unit 26.

A. Hough Conversion Means

The Hough conversion operated by the sum of product circuit 20 will be explained. The Hough conversion is also explained in K. Hanahara, T. Maruyama and T. Uchiyama, "A Real-Time Processor for the Hough Transform" IEEE Trans. Pattern Anal. Machine Intel., Vol. PAMI-10, No. 1, pp. 121–125, Jan. 1998. The brief explanation will use a specific picture as an example.

Figure 3:
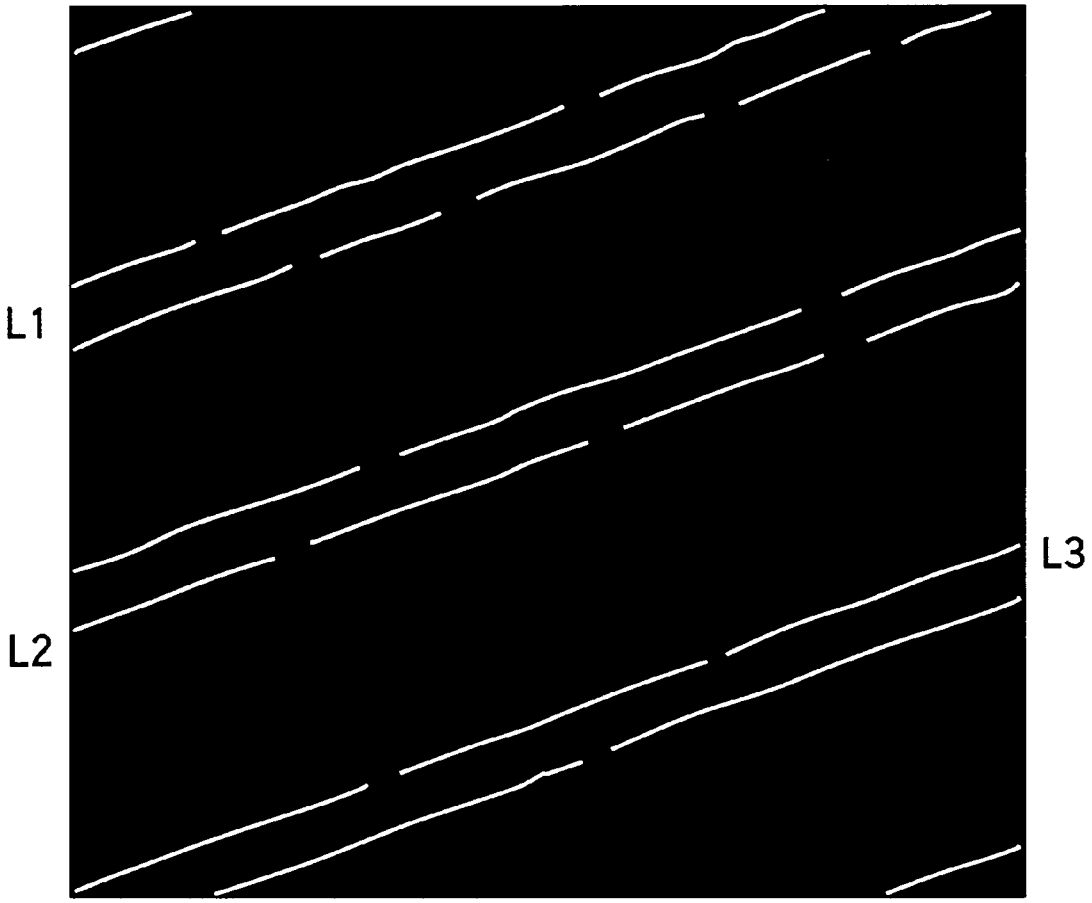
FIG. 3 shows a sample picture of an example of an input binary picture of the present embodiment.

FIG. 3 shows a binary picture including line components. The white part in the figure is the active picture element, and the black part in the figure is the non-active picture element. Shown as L1, L2, and L3, the active picture element constitutes a plural number of lines. The linear Hough conversion is applied to this binary picture element. The line can be expressed as equation (1) shown below, using a length ρ and an angle θ. The length ρ is the length of the normal line from the predetermined point of origin. The angle θ is the angle between the normal line and the y axis.

$$\rho = x\cos\theta \text{ and } +y\sin\theta \tag{1}$$

One line is expressed as one point on the ρ–θ plane. Using the linear Hough conversion, one point on the x–y plane expresses a group lines which pass through that one point. These lines becomes a sine curve on the ρ–θ plane. This sine curve is called a Hough curve.

Figure 4:
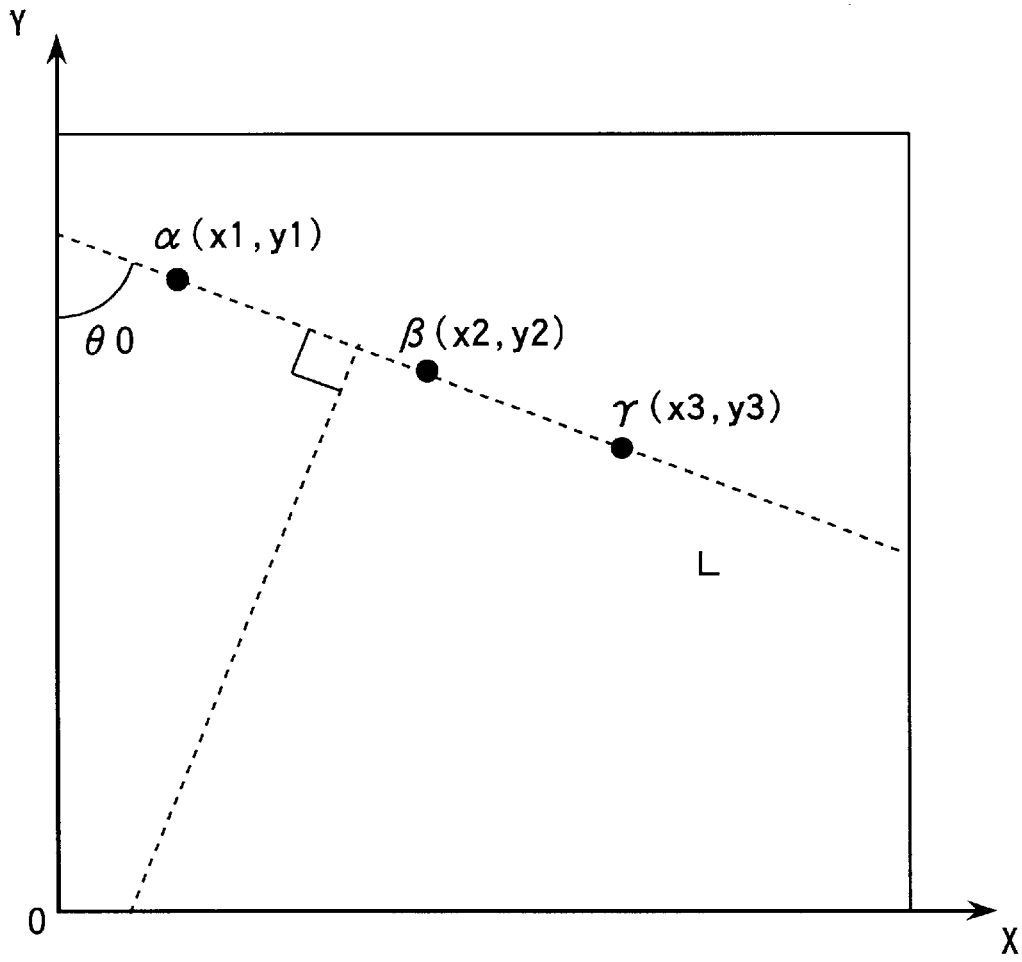
FIG. 4 shows a binary picture in which an active picture element having three picture elements is located on the line L.
Figure 5:
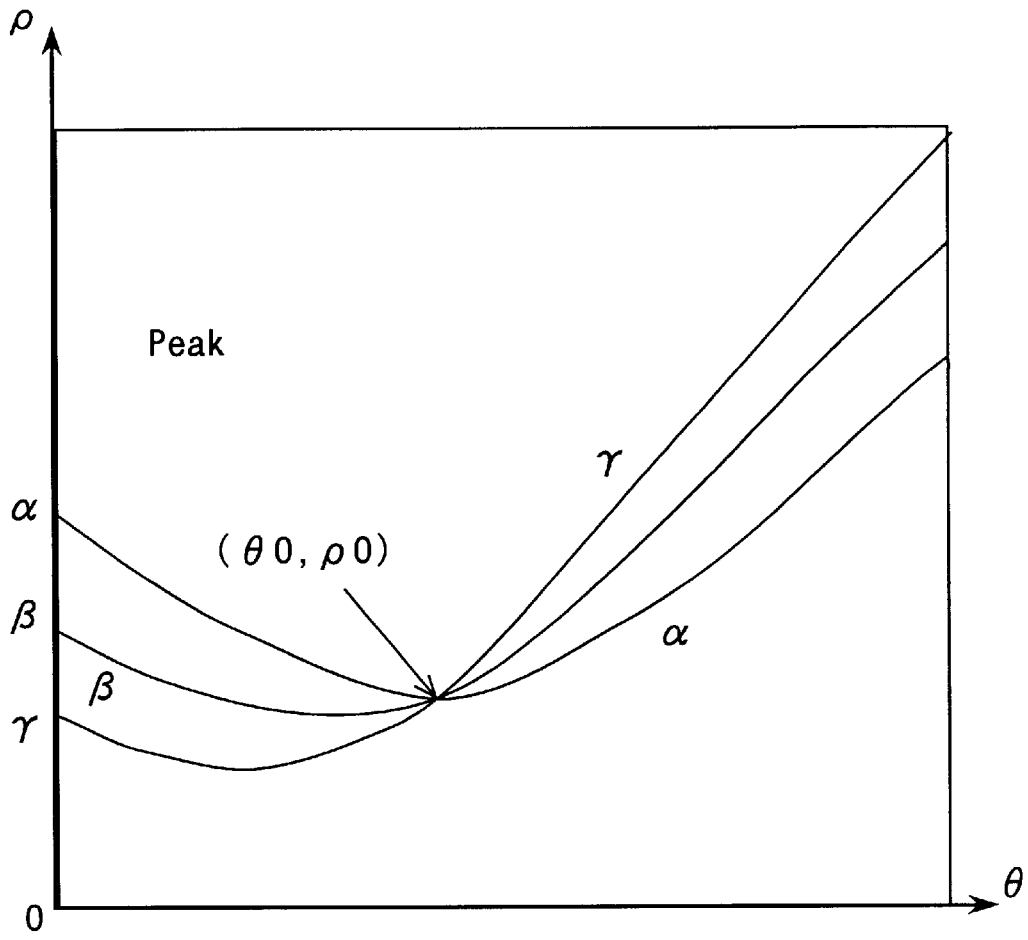
FIG. 5 shows the resultant picture after the binary picture shown in FIG. 4 is processed with Hough conversion.

If the three points α(x1, y1), β(x2, y2), and γ(x3, y3) shown in FIG. 4 are located on the line L, the corresponding Hough curve is intersected at the point ($\theta_0$, $\rho_0$) which corresponds to the line L as shown in FIG. 5. Therefore, the line can be expressed as an intersection point of the plurality of Hough curves in the ρ–θ plane. The luminance of the intersection point increases in proportion to the numbers of Hough curves crossing the intersection point.

Figure 6:
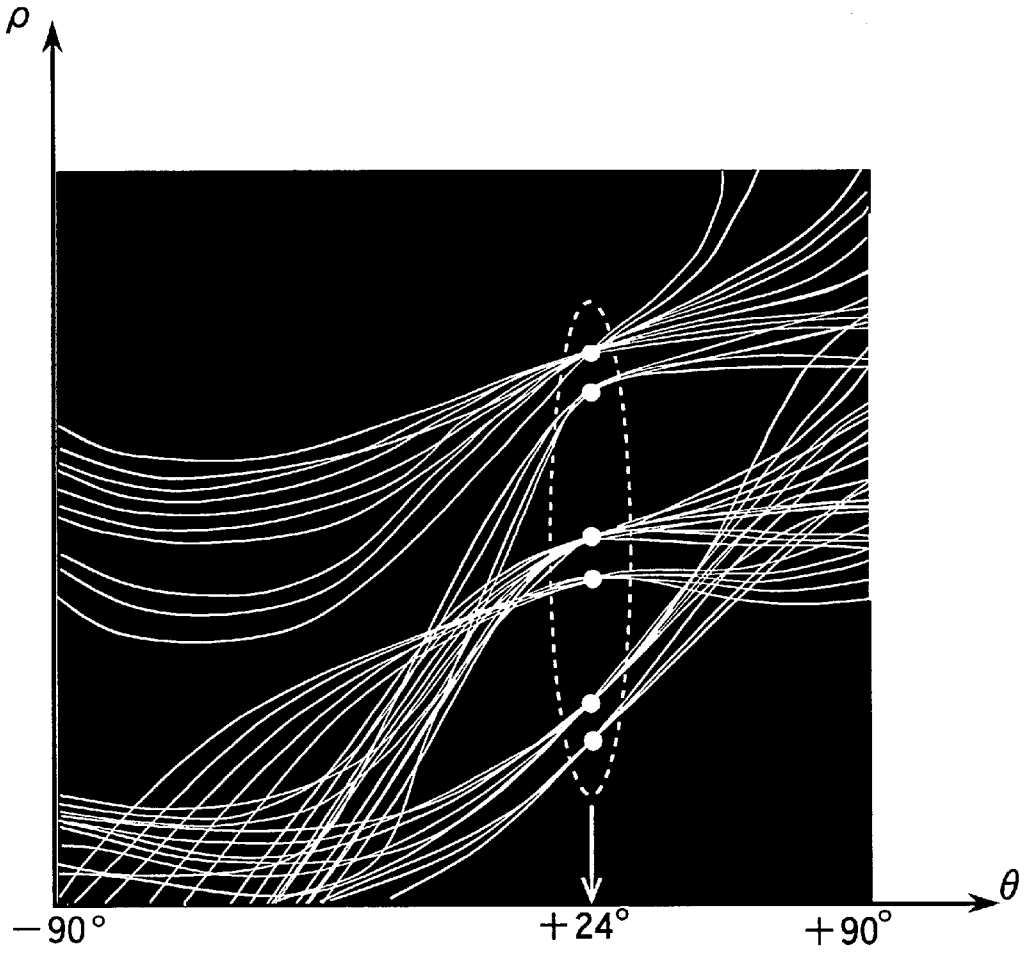
FIG. 6 shows the resultant picture after the sample binary picture shown in FIG. 3 is processed with Hough conversion.

FIG. 6 shows the result of applying the linear Hough conversion on the picture shown in FIG. 3. There are some points which have a high luminance value in the vicinity of θ=24° in the ρ–θ plane. Six numbers of the peak corresponding to the pair of the lines L1, L2, and L3 shown in FIG. 3 can be detected, for example, based on the threshold value of the luminance value. The locations, where the six numbers of the peak are realized, are all in the vicinity of θ=24°. Therefore, it can be detected that the rotation angle of the wiring pattern is 24° in the input picture shown in FIG. 3. As shown above, the location and the angle of the line in the picture can be detected using the linear Hough conversion.

B. ν MOS Sum of Product Circuit

The sum of product circuit 20 operates the Hough conversion sum of product operation shown in the equation (1) using an analog circuit to which is applied a ν MOS transistor. The ν MOS transistor is explained in T. Shibata and T. Ohmi "A Functional MOS Transistor Featuring Gate-leve Wighted Sum and Threshold Operations" IEEE Trans. Electron Devices, vol. 39, No. 6, pp. 121–132, June 1992. The ν MOS sum of product circuit will therefore be explained briefly only.

Figure 7:
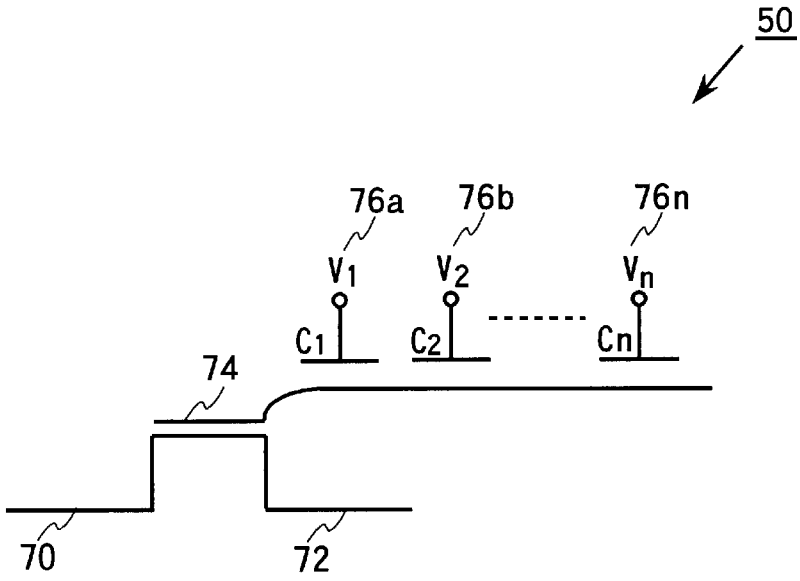
FIG. 7 shows a circuit configuration diagram of a ν MOS transistor.

FIG. 7 shows the configuration of the ν MOS. The ν MOS is a MOS transistor which has a floating gate 74 and a plurality of input gates 76*a*, 76*b*, . . . , 76*n* arranged in parallel. Because the typical MOS transistor has only one gate, the switch can be turned on and off, depending on the voltage applied on to gate. Because the configuration of the drain 70 and the source 72 of the ν MOS transistor shown in FIG. 7 is the same as that of the conventional MOS transistor, the drain current can be determined by the voltage applied on the floating gate 74. The voltage applied to the floating gate 74 is determined by the sum of a plurality of gate voltages V1, V2, . . . , Vn.

Figure 8:
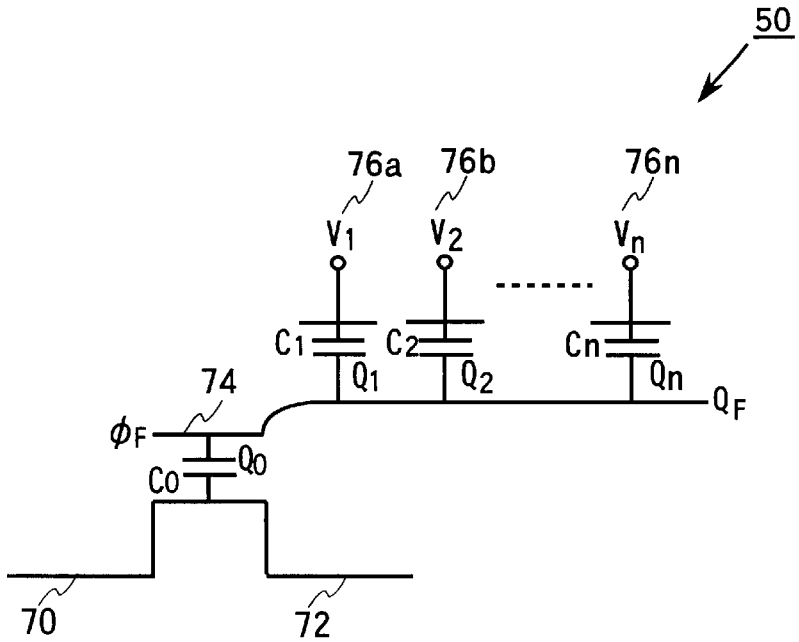
FIG. 8 shows an equivalent circuit in which a capacity of a ν MOS transistor is shown by model.

FIG. 8 shows the actual model for obtaining the electric potential $\phi_F$ of the floating gate 74. The sum of the electric charge $Q_F$ stored in the capacity of the input gate side can be expressed by the equation (2) shown below, where the electric potential of the floating gate 74 is $\phi_F$.

$$Q_F = \sum_{i=1}^{n} C_i(\phi_F - V_i) \tag{2}$$

The electric charge $Q_0$ stored in the capacity of the substrate side can be expressed as:

$$Q_0 = C_0\phi_F \tag{3}$$

Because $Q_0 = Q_F$, $$\sum_{i=1}^{n} C_i(V_i - \phi_F) = -C_0\phi_F \tag{4}$$

Using this equation (4), the electric,potential $\phi_F$ of the floating gate 74 can be expressed as:

$$\phi_F = \frac{C_1V_1 + C_2V_2 + \ldots + C_nV_v}{C_0 + C_1 + C_2 + \ldots + C_u} \tag{5}$$

Figure 9:
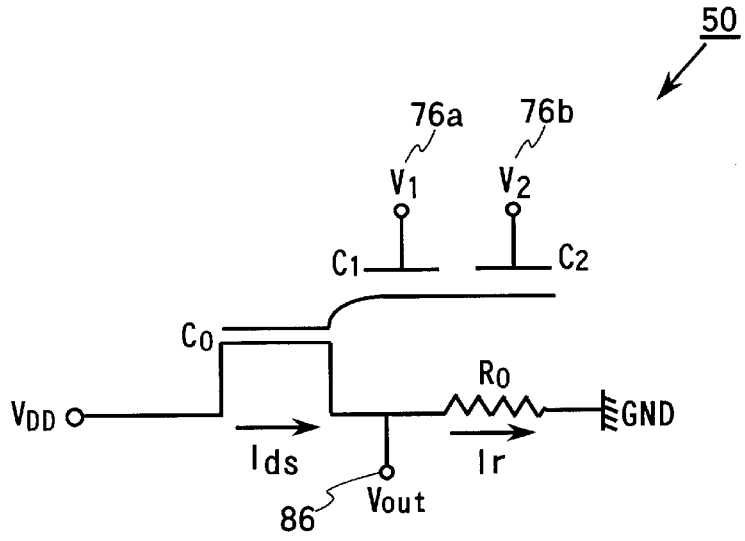
FIG. 9 shows a configuration diagram of a ν MOS sum of product circuit.

FIG. 9 shows a circuit diagram of a ν MOS sum of product circuit. Here, the ν MOS sum of product circuit has two input gates 76*a* and 76*b*. Using the equation (5), the electric potential $\phi_F$ of the floating gate 74 can be expressed as:

$$\phi_F = \frac{C_1V_1 + C_2V_2}{C_0 + C_1 + C_2} \tag{6}$$

In this circuit, as clear from the direction of the drain current shown in FIG. 9, the Vout side is the source 72. Therefore, Vds=Vdd−Vout, Vgs=$\phi_F$−Vout. It follows that Vds−(Vgs−Vt)=Vdd−$\phi_F$+Vt. If the Vt>0, because $\phi_F$<5V, then Vds−(Vgs−Vt)>0, and Vds>Vgs−Vd is thus valid. Therefore, this n MOS transistor is always operated within the saturation region. The drain current Ids can be obtained using the following equation (7).

$$I_{ds} = \beta/2(\phi_F - V_{out} - V_t)^2 \tag{7}$$

The current Ir which flows through the resistor Ro can be expressed as:

$$I_r = \frac{V_{unit}}{R_0} \tag{8}$$

Because Ids=Ir, $$\frac{\beta}{2}(\phi_F - V_{out} - V_t)^2 = \frac{V_{out}}{R_0} \tag{9}$$

Then, the Vout can be obtained using the following equation (10).

$$V_{out} = \left(\phi_F - V_t + \frac{1}{\beta R_0}\right) \pm \sqrt{\frac{2}{\beta R_0}(\phi_F - V_t) + \left(\frac{1}{\beta R_0}\right)^2} \tag{10}$$

Because $\beta=7\times10^{-5}$, if the Ro is more than several 10 k Ω, the formula inside the square root becomes:

$$\frac{2}{\beta R_0}(\phi_F - V_t) << \left(\frac{1}{\beta R_0}\right)^2 \tag{11}$$

Furthermore, because 0V<Vout<5V, the equation (10) becomes:

$$V_{out} \approx \left(\phi_F - V_t + \frac{1}{\beta R_0}\right) - \sqrt{\left(\frac{1}{\beta R_0}\right)^2} = \phi_F - V_t \tag{12}$$

The circuit shown in FIG. 9 outputs the voltage Vout which changes linearly with the electric potential $\phi_F$ of the floating gate 74. If the threshold voltage is set as Vt=0 V, a circuit which outputs the same voltage as the input voltage can be constructed. According to the equation (6) and the equation (12), the input and output of the source follower circuit shown in the FIG. 9 can be expressed as:

$$V_{out} = \frac{C_1V_1 + C_2V_2}{C_0 + C_1 + C_2} - V_t \tag{13}$$

If setting Vt=0 V, and Ctotal=Co+C1+C2, the Vout can be expressed as:

$$V_{out} = \frac{1}{C_{TOTAL}}(C_1V_1 + C_2V_2) \tag{14}$$

Therefore, the circuit shown in FIG. 9 becomes the sum of product operating unit with which the coefficient 1/Ctotal is multiplied. As shown above, the circuit shown in FIG. 9 becomes a sum of the product circuit. Even in the case where Vt≠0 V, it only influences the result of the sum of the product operation such that the constant offset is added to the result of the operation, and does not influence other contents of the sum of the product operation.

C. Linear Hough Operation Circuit

If setting C1 (θ) ∝ sin θ and C2 (θ) ∝ cos θ, and setting input voltage as an analog value (Vx, Vy) in the x, y coordinates value of the active picture element in the binary picture, and setting input gate capacity as Csin(θ), Ccos(θ) in the equation (14), which shows the workings of the sum of the product circuit explained above. Then, the equation (14) becomes:

$$V_{out}(\theta) = \frac{1}{C_{TOTAL}}(C\cos(\theta)\cdot Vx + C\sin\theta)\cdot Vy) \tag{15}$$

The equation (15) is equivalent to the equation (1) of the Hough conversion operation.

The value of the Ctotal is desirable to be a constant, but because:

$$C_{TOTAL}=C_0+C\mathrm{COS}(\theta)+C\sin(\theta) \tag{16}$$

and sin θ+cos θ is not constant, the Ctotal is also not constant. Therefore the input gate of the capacity Ctotal shown in the next equation is placed between the circuit shown in FIG. 9 and earth.

$$C_{add}=C_{const}-C\cos(\theta)+C\sin(\theta) \tag{17}$$

Figure 10:
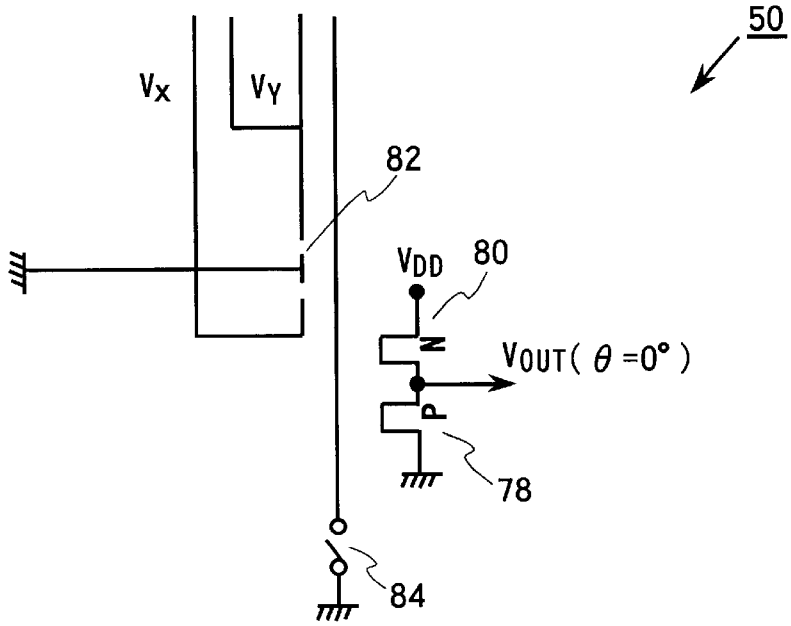
FIG. 10 shows a circuit configuration diagram of a ν MOS transistor used in the present embodiment.

FIG. 10 shows the ν MOS circuit 50 which added the input gate of the capacity Ctotal. In FIG. 10, the PMOS 78 is used as the circuit element Ro of FIG. 9, and the CMOS, in which the NMOS 80 and the PMOS 78 are located, uses the common floating gate 74. By using the channel resistance of the MOS transistor as load resistance, relatively high resistance can be obtained by a small area. Ctotal is set as a sufficient value such as the maximum value of the C cos θ+C sin θ. By connecting the added input gate to the ground (=0V) the Ctotal can be constant, even if θ changes. The output voltage Vout which is added the ground input gate can be expressed as:

$$V_{out}(\theta) = \frac{1}{C_{TOTAL}}(C\cos(\theta)\cdot Vx + C\sin(\theta)\cdot Vy + C_{odd}\cdot 0) \tag{18}$$

Therefore, the desired sum of the product operation can be operated.

Figure 11:
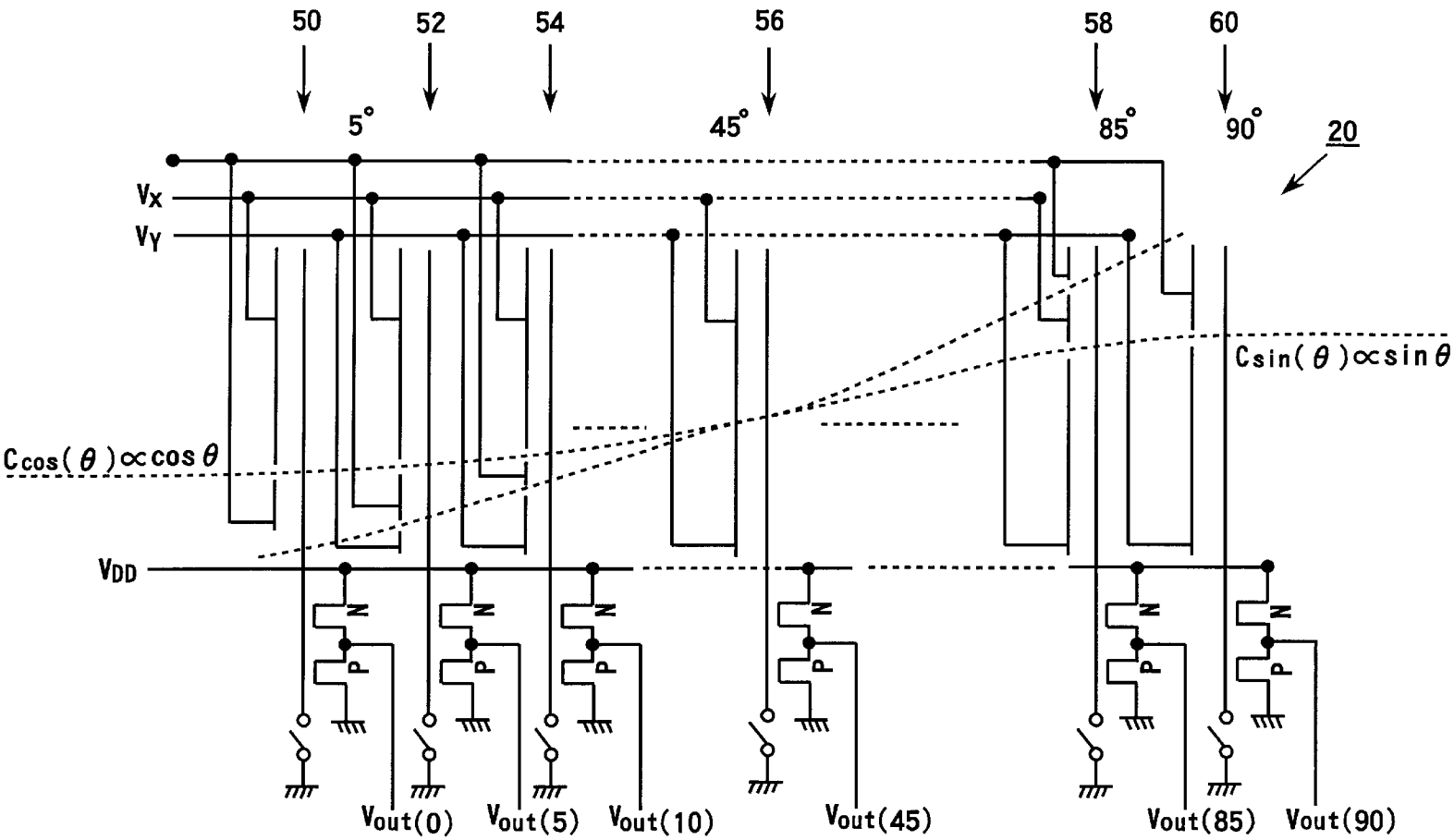
FIG. 11 shows a circuit diagram in which a plurality of linear Hough conversion operating circuits constituted by ν MOS transistors are arranged in parallel.

FIG. 11 shows the circuit which has a plurality of ν MOS transistors 50 to 60 arranged in parallel. The capacities connected to the two input gates at each of the ν MOS are set proportional to the value of the C sin (θ) and C cos (θ) for each different θ. The analog values in the x address and the y address are input to each of the ν MOS. The Hough conversion operation on an active picture element can be undertaken simultaneously, for several kinds of θ.

Figure 12:
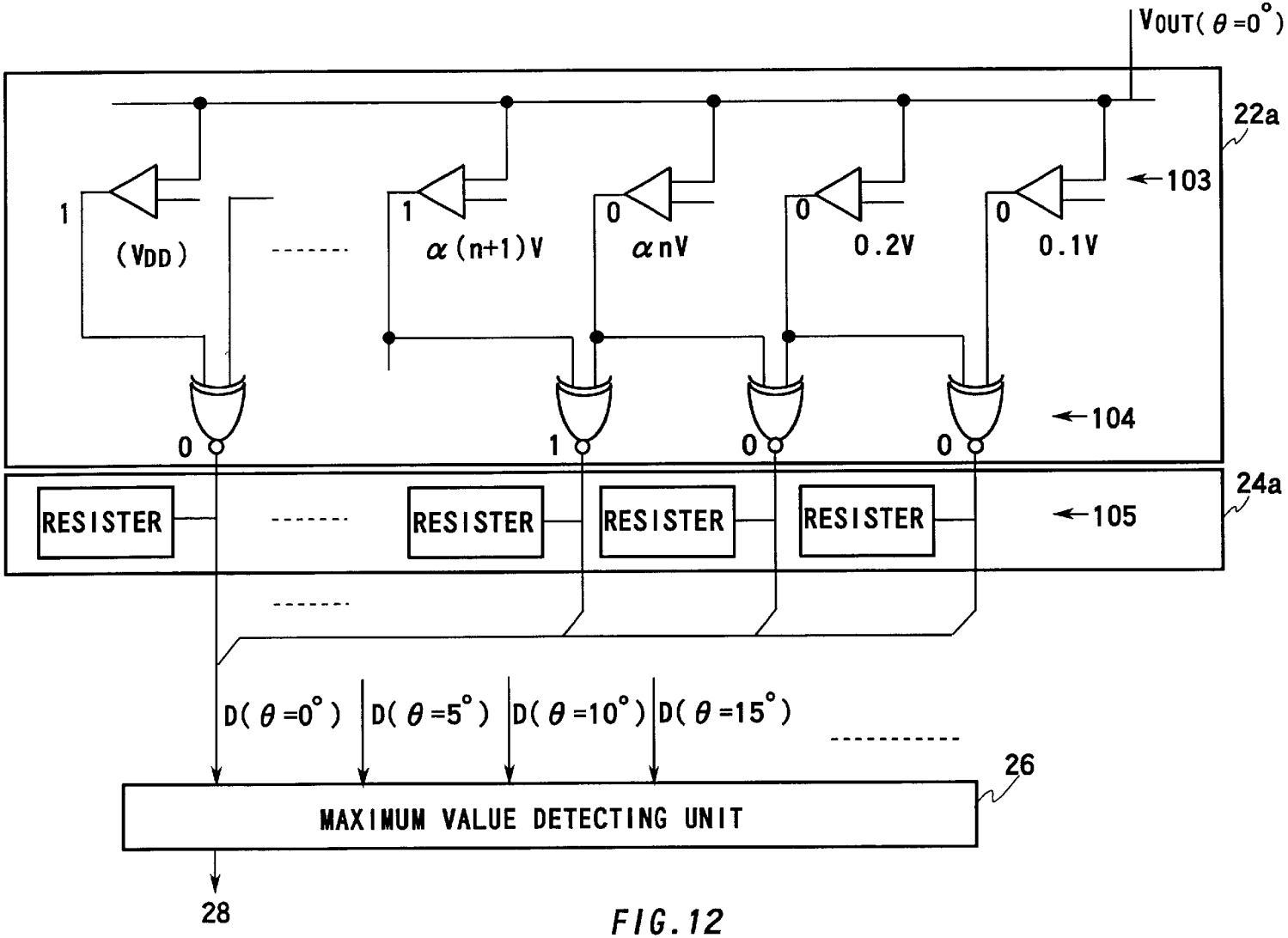
FIG. 12 shows a block diagram of a detailed configuration of an increase means element 22*a* and a two-dimensional memory element 24*a*.

FIG. 12 shows an increase means element 22*a* and a two-dimensional memory element 24*a*. The increase means element 22*a* is part of the increase means 22. The two-dimensional memory element 24*a* is part of the two-dimensional memory 24. The increase means element 22*a* and the two-dimensional memory element 24*a* shown in FIG. 12 are provided independently for each output output from the plurality of ν MOS transistors 50 to 60 shown in FIG. 11.

The increase means element 22*a* has a plurality of comparators 103. The reference voltage is different for each comparator 103, and the output Vout output from the sum of product circuit 20 is input to each comparator 103. The comparator 103 outputs 1 when the input voltage Vout is larger than the reference voltage, and outputs 0 when the input voltage Vout is smaller than the reference voltage. By inputting to the exclusive or circuit 104, the output of two adjacent comparators, the output of the exclusive or circuit 104 which is connected to the comparator 103 where the reference voltage closest to the Vout voltage is input, becomes 1. Then, the output of the other exclusive or circuit 104 becomes 0.

Figure 13:
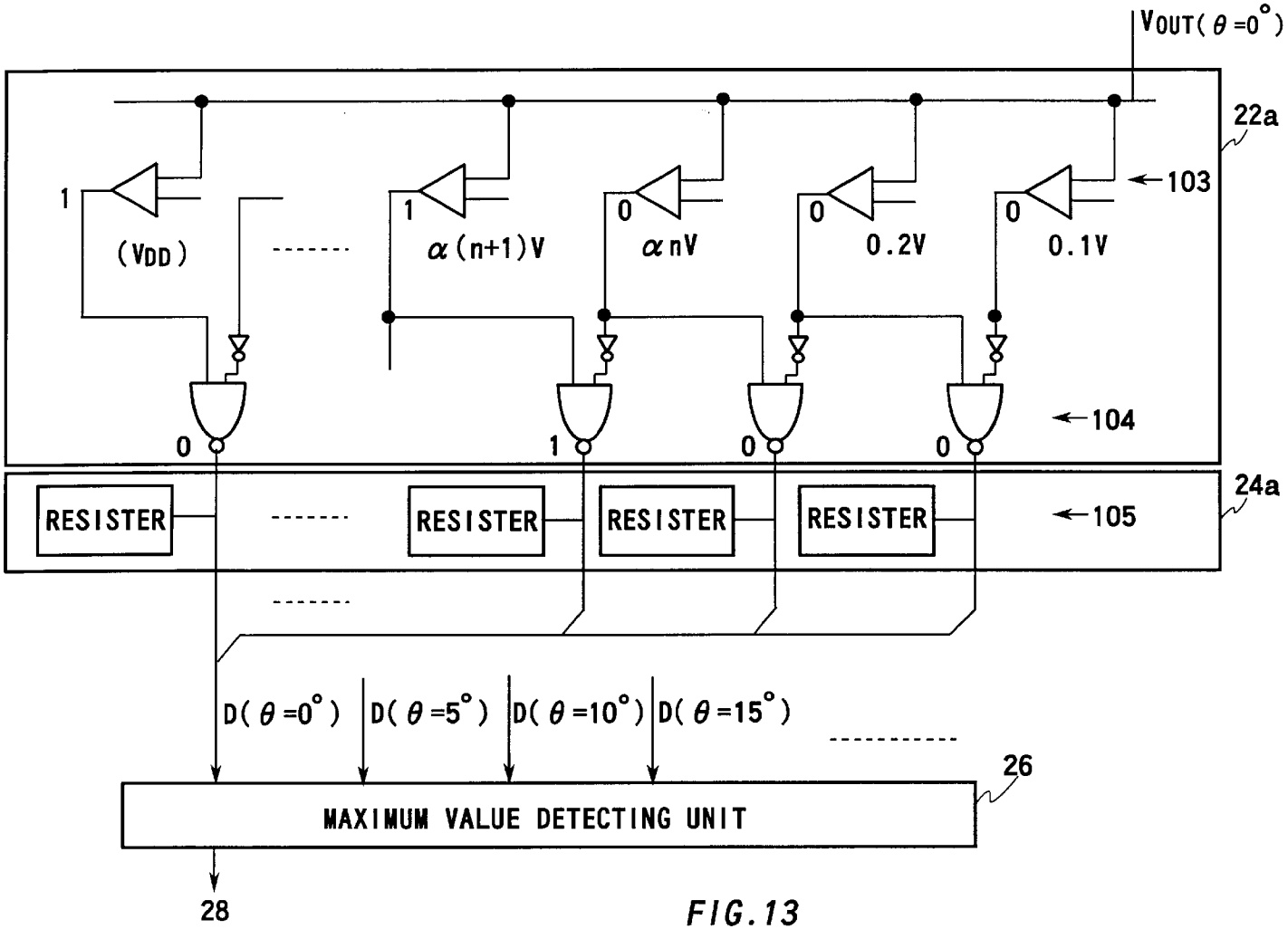
FIG. 13 shows a block diagram of an another configuration of an increase means element 22*a* and a two-dimensional memory element 24*a*.

Instead of using the exclusive or circuit 104, a logic circuit, which outputs 0 only when the output of the corresponding comparator is 0 and the output of the comparator one above the corresponding comparator is 1, can be used. In this case, for example as shown in FIG. 13, the output of the corresponding comparator can be input to the NOT gate, and the output of the NOT gate and the output of the comparator one above the corresponding comparator can be input to the NAND gate.

The two-dimensional memory element 24*a* has a plurality of resistors 105 each corresponding to ρ. The increase means 22 increases the value of the resister 105, which is connected to the exclusive or circuit 104 that outputs 1, in increments of 1. By repeating the operation shown above for each plurality of active picture element, the input picture can be Hough converted.

After finishing the Hough conversion processing, t he maximum value detecting unit 26 reads the value of each resistor 105 included in each two-dimensional memory element 24*a* in the two-dimensional memory 24. The maximum value detecting unit 26 then outputs the address of the maximum value. The maximum value detecting unit 26 detects the location and the rotation angle of the line in the input binary picture based on this address.

The voltages Vx, Vy, which are analog inputs, are applied to the sum of product circuit 20. For example, when Vx=5V, Vy=5V, θ=45°, and the input gate capacity is C sin (θ)=sin θ×100 (Femtofarad), C cos (θ)=cos θ×100 (Femtofarad), Cadd=0 (Farad), Co=35 (Femtofarad), then the Vout of the equation (18) becomes approximately 4 (V).

Figure 14:
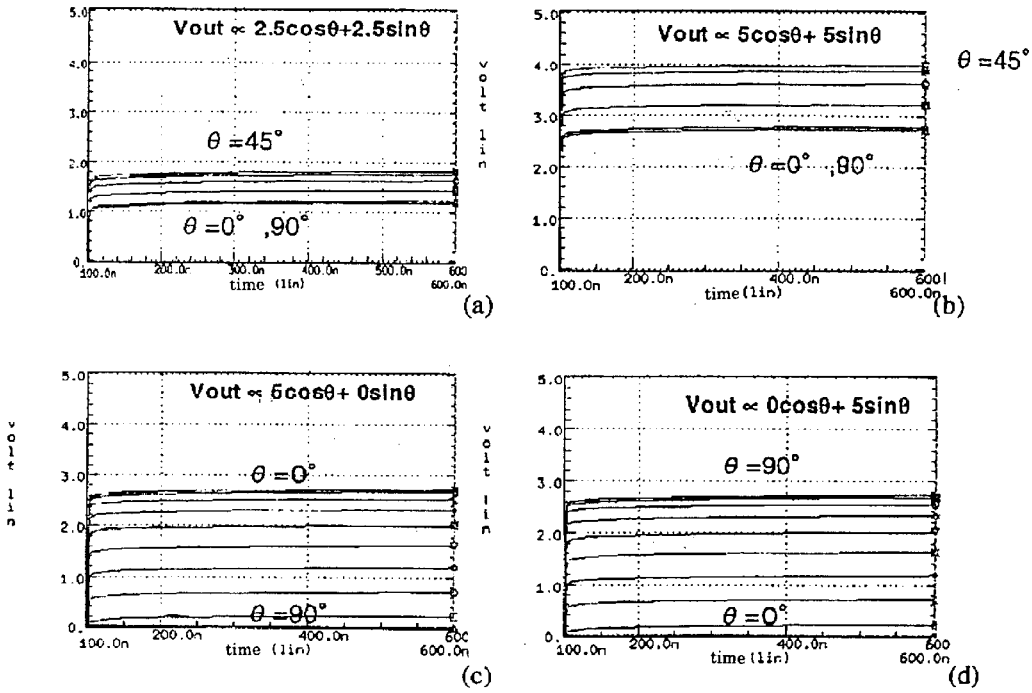
FIG. 14 shows a result of HSPICE simulation of a Hough conversion process circuit shown in FIG. 10.

FIG. 14 shows the result of transient analysis using the circuit simulation (a brand name: HSPICE) on each of the conditions of (Vx, Vy)=(2.5V, 2.5V), (5V, 5V), (5V, 0V), (0V, 5V), and θ=0°, 10°, . . . , 90°. Because the voltage Vout, which is approximately equivalent to the Vout calculated from the equation (15), is detected, it is known that the circuit shown in FIG. 10 works properly as a Hough conversion circuit.

Figure 15:
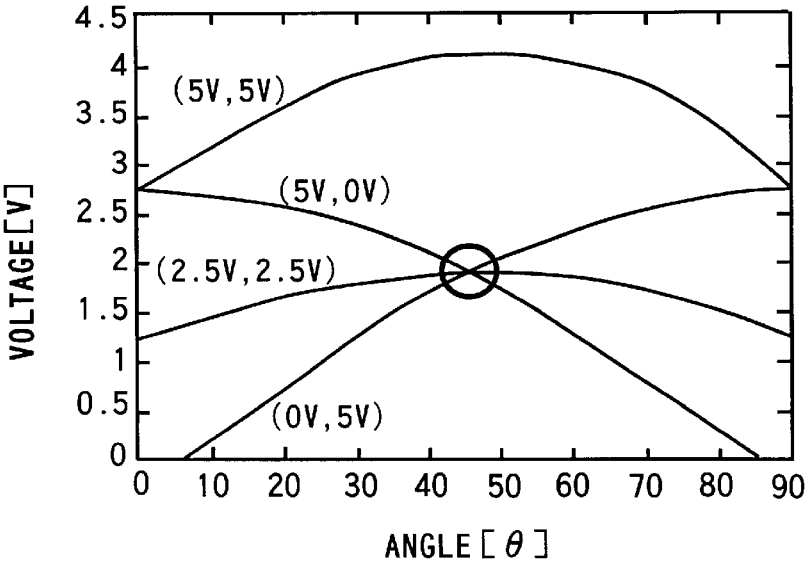
FIG. 15 shows a result of HSPICE simulation in which the contents of the two-dimensional memory shown in FIG. 12 after processing with a Hough conversion are shown graphically.

FIG. 15 shows the value stored in the two-dimensional memory 24 when changing the θ within a range of 0°≦θ≦90° upon four types of input voltage as shown in the FIG. 14. The three points of (0V, 5V), (2.5V, 2.5V), (5V, 0V), are located on the line of 45° in the Vx−Vy plane, and the corresponding three Hough curves are intersected at θ=45° Therefore, it can be established that the inclination detecting apparatus of the present embodiment stores the result of the Hough conversion in the two-dimensional memory 24.

The inclination detecting apparatus of the present embodiment can operate a linear Hough conversion for one active picture element and store the results of the conversion in the two-dimensional memory in approximately 500 ns. Therefore, if the number of active picture elements inside the binary picture is 1024 picture elements, the inclination detecting apparatus can finish the process in 0.5 ms. If using a digital circuit to do the same process, it takes approximately 16.7 ms in 20 MHz of clock frequency. The operating speed of the inclination detecting apparatus of the present embodiment is therefore approximately 33 times faster than a conventional inclination detecting apparatus that uses a digital circuit.

Furthermore, in the case of operating the Hough conversion in a range of 0°≦θ≦90° at one degree of the resolving power in parallel, approximately 200 K of transistors are needed for the COMS logic circuit. The inclination detecting apparatus of the present embodiment needs only 0.36 K of transistors for the same operation. Therefore, the number of transistors required for the inclination detecting apparatus of the present invention is one five hundred and fiftieth (1/550) of that of the conventional inclination detecting apparatus. Furthermore, the area of integrated circuit of the inclination detecting apparatus of the present embodiment is approximately one thirtieth (1/30) of that of the conventional inclination detecting apparatus.

Figure 16:
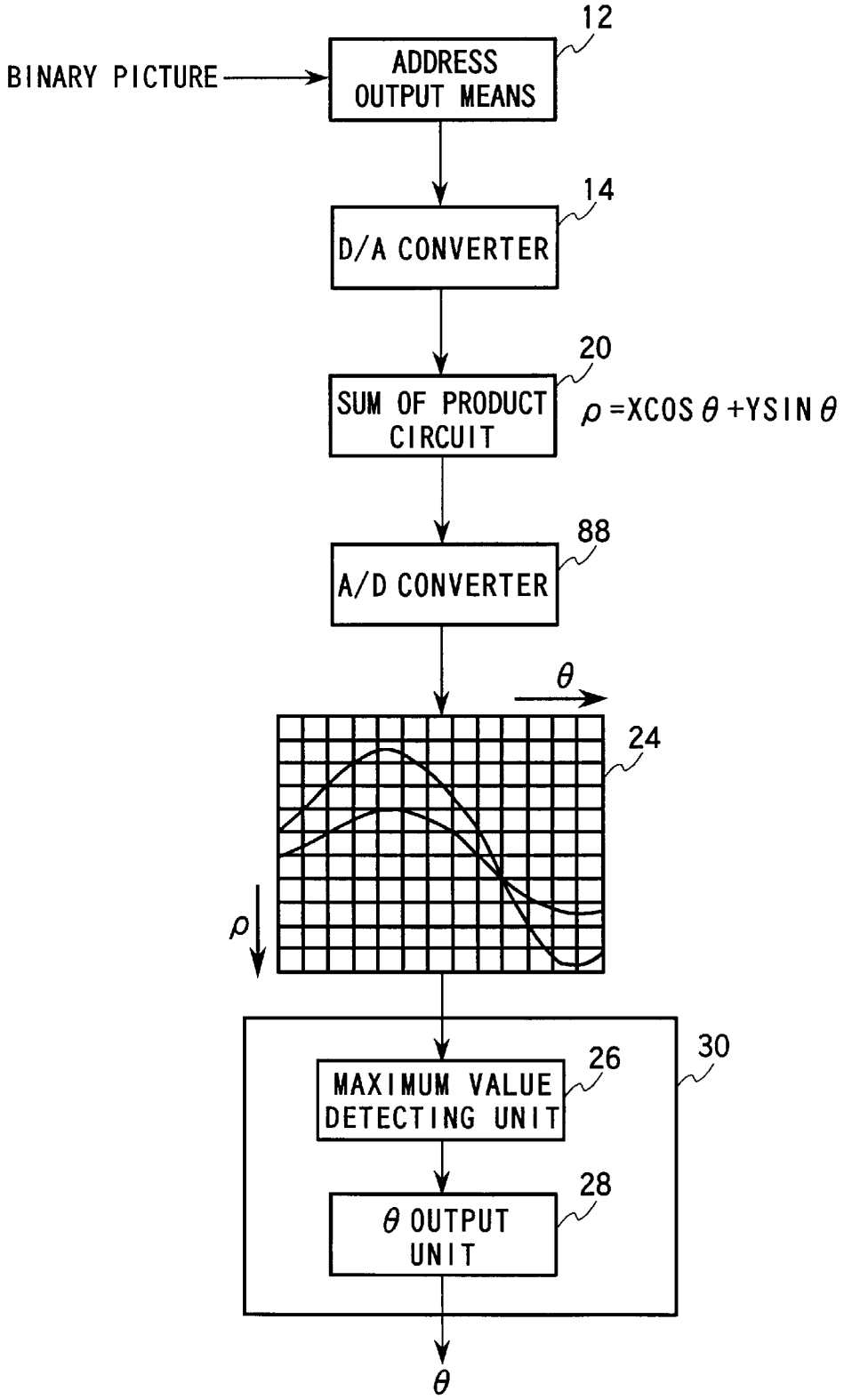
FIG. 16 shows another embodiment of the inclination detecting apparatus.

FIG. 16 shows another embodiment of the present invention. The inclination detecting apparatus shown in FIG. 16 has an A/D converter 88. The A/D converter 88 converts the analog output, which is output from the sum of product circuit 20 explained using FIG. 10, to a digital value. The inclination detecting apparatus shown in FIG. 16 uses the DSP, Digital Signal Processor, to store the data in the two-dimensional memory 24 and detect the maximum value. Therefore, the size of the inclination detecting apparatus can be reduced because the increase means elements 22*a* and the two-dimensional memory elements 24*a* provided for each of angle θ become unnecessary. The configuration shown in FIG. 15 having the same code as FIG. 10 has the same function and workings as that of the configuration shown in FIG. 10. The explanation of the elements having the same code will thus be omitted.

As another further embodiment, the two-dimensional memory 24 and the maximum value detecting unit 26 can be provided by a general purpose computer and software which works on a computer. By using software, the size of the inclination detecting apparatus can be reduced because the two-dimensional memory 24 and the maximum value detecting unit 26 become unnecessary. Furthermore, the angle θ can be detected by storing address data in storing mediums such as magnetic optical disk and processing the stored address data by a computer. Thus, the processing speed can be increased by using a computer having a high operation ability.

As another further embodiment, the inclination of the object picture can be calculated based on a plurality of points having a large luminance on the ρ−θ plane. For example, there is a method of calculating the inclination of the object picture based on all the points having a luminance greater than a threshold value. In this case, the threshold value is determined as the luminance, including the points having upper 10 percent of the luminance by taking the histogram of the previous luminance.

In the case of calculating the inclination of an object picture based on a plurality of points as shown above, it is preferable to obtain the average of the sum of the product by multiplying the inclinations θ1, θ2, . . . , of the object picture which are calculated by each of the points, by weights a1, a2, . . . . , which are determined based on the luminance. Therefore, the inclination θ of the object picture can be calculated using the following equation.

$$\theta=(a1\theta1+a2\theta2+\ldots)/(a1+a2+\ldots)$$

The inclination θ of the object picture can also be simply determined by using the median or average value of the inclination of the object pictures, each calculated based on a plurality of selected points.

Furthermore, each of the inclination data θ1, θ2, . . . , calculated based on each point, can be output as a histogram by matching each inclination data to the luminance of each point. In this case, if a plurality of points is selected in the same angle θ, it is preferable to output the total value of the luminance of the plurality of points by matching the total value of the luminance to the angle θ. The calculated angle of the object picture, and magnitude of the error included in the calculated angle can be known using this histogram. Furthermore, the likelihood that the inclination of the object picture is within a calculated prescribed range, for example ±5°, can be output together with the histogram.

As shown above, the ν MOS analog sum of product circuit can process the Hough conversion, which requires a large scale circuit configuration when assembled by conventional digital circuit technology, in a small scale circuit configuration. Furthermore, ν MOS analog sum of product circuit can process the Hough conversion at high speed.

Although the present invention has been described by way of exemplary embodiments, it should be understood that many changes and substitutions may be made by those skilled in the art without departing from the spirit and the scope of the present invention which is defined only by the appended claims.

What is claimed is:

1. A sum of product circuit, which outputs a sum of product value that adds a value multiplying a first input voltage by a cosine value cos θ at a prescribed angle θ and a value multiplying a second input voltage by a sine value sin θ at said prescribed angle θ, comprising:

a ν MOS transistor which has a drain, a source, and a floating gate;

a first condenser which connects said first input voltage to said floating gate by capacity coupling and having a capacitance of said cosine value cos θ;

a second condenser which connects said second input voltage to said floating gate by capacity coupling and having a capacitance of said sine value sin θ;

a resister element which is connected to said ν MOS transistor; and an output terminal which outputs an electric potential between said resister element and said ν MOS transistor;

wherein said sum of product value is output from said output terminal by applying a constant voltage between said drain and said source through said resister element.

2. A sum of product circuit as claimed in claim 1, wherein said resister element has a MOS transistor.

3. A sum of product circuit as claimed in claim 1 further comprising a third condenser which connects said floating gate and ground.

4. A sum of product circuit as claimed in claim 1, wherein said ν MOS transistor is an N channel ν MOS transistor, and said drain is connected to an electric potential higher than an electric potential of said source.

5. A sum of product circuit as claimed in claim 1, wherein said ν MOS transistor is a P channel ν MOS transistor, and said source is connected to an electric potential higher than an electric potential of said drain.

6. A sum of product circuit as claimed in claim 1 further comprising a plurality of said ν MOS transistors;

wherein said resister element, said first condenser, and said second condenser are provided independently for each of said plurality of ν MOS transistors.

7. A sum of product circuit as claimed in claim 1, wherein a sum of a square of a capacitance of said first condenser and a square of a capacitance of said second condenser is equal for each of said plurality of ν MOS transistors.

8. A sum of product circuit as claimed in claim 1 further comprising a switch which connects said floating gate to ground electric potential.

* * * * *